US009138787B1

(12) United States Patent
Haffner et al.

(10) Patent No.: US 9,138,787 B1
(45) Date of Patent: Sep. 22, 2015

(54) SYSTEM AND METHOD FOR DE-GASSING AND NEUTRALIZING EQUIPMENT

(71) Applicants: Kenneth Haffner, Livingston, LA (US); Richard Luper, Livingston, LA (US)

(72) Inventors: Kenneth Haffner, Livingston, LA (US); Richard Luper, Livingston, LA (US)

( * ) Notice: Subject to any disclaimer, the term of this patent is extended or adjusted under 35 U.S.C. 154(b) by 0 days.

(21) Appl. No.: 14/488,395

(22) Filed: Sep. 17, 2014

(51) Int. Cl.
*B08B 9/032* (2006.01)

(52) U.S. Cl.
CPC ..... *B08B 9/0325* (2013.01)

(58) Field of Classification Search
CPC ..... A61L 2/18; B08B 9/032
USPC ..... 422/28, 31; 137/15.05, 240
See application file for complete search history.

(56) References Cited

U.S. PATENT DOCUMENTS

| | | | | |
|---|---|---|---|---|
| 5,089,226 | A | 2/1992 | Ohashi | |
| 6,273,102 | B1 | 8/2001 | Kawakami | |
| 6,547,959 | B1 | 4/2003 | Frost | |
| 6,652,660 | B2 | 11/2003 | Frost | |
| 8,323,416 | B2 | 12/2012 | Bradley | |
| 2005/0139238 | A1 * | 6/2005 | Ferrara | 134/22.11 |
| 2012/0141318 | A1 | 6/2012 | Osuki | |

FOREIGN PATENT DOCUMENTS

WO WO 2013/048433 A1 4/2013

* cited by examiner

*Primary Examiner* — Sean E Conley
(74) *Attorney, Agent, or Firm* — Andrew G. Vicknair

(57) ABSTRACT

A system and method for de-gassing, neutralizing, and decontaminating various equipment with a clean hydrocarbon-free chemical solution such that maintenance of various equipment may begin sooner.

19 Claims, 1 Drawing Sheet

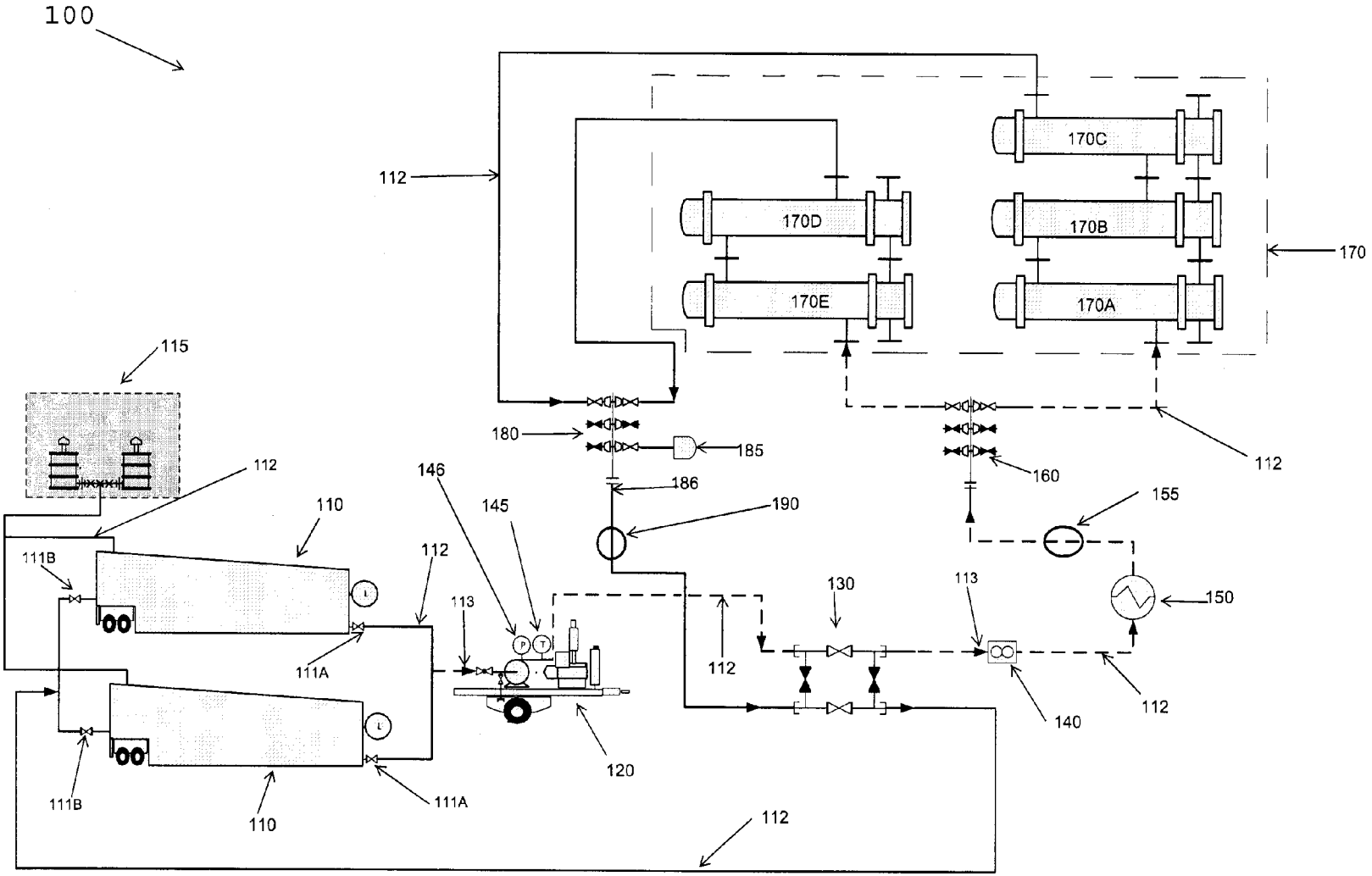
100
170
170A
170B
170C
170D
170E
112
150
155
160
140
113
130
190
185
186
180
120
145
146
111A
111B
110
115

SYSTEM AND METHOD FOR DE-GASSING AND NEUTRALIZING EQUIPMENT

TECHNICAL FIELD

The present invention relates, in general to a de-gassing and neutralization process and system, and more specifically to the use of specific formulations and a specific system and process in order to de-gas and neutralize equipment including, but not limited to, refinery process equipment, in order to protect Austenitic stainless steels and other alloys from polythionic acid stress corrosion cracking in a shortened period of time.

BACKGROUND OF INVENTION

Currently, the energy industry is a rapidly expanding and very important industry for the day-to-day operations of society. Energy production comes from several sources, such as the petroleum industry, the gas industry, the electrical power industry, the coal industry, and the nuclear power industry. Some new energy industries include the renewable energy industry which includes alternative and sustainable manufacture, distribution, and sale of alternative fuels such as wind, solar, biodiesel, bioalcohol, chemically stored electricity in the form of batteries and fuel cells, non-fossil natural gas, and other sources. While these new energy industries attempt to reduce the need for conventional fuels such as petroleum, coal, and natural gas, these new energy industries are simply not able to produce the energy needed by modern day society.

In order to meet the ongoing demand for energy, several petroleum refining facilities are in operation throughout the world and often run non-stop throughout extended periods of time to meet the needs of society. While these refineries run non-stop for extended periods of time, portions of process units in refineries, petrochemical plants, power plants, and other energy industry facilities will routinely schedule shutdowns, turnarounds or times when a process unit is taken offline in order to revamp and maintain the facility. Turnarounds are very expensive because of the lost production while a process unit is offline and due to the costs of tools, heavy equipment, materials, labor, and other expenses incurred in successfully executing a turnaround and performing much needed maintenance to the process equipment.

During a turnaround, vessels and equipment exposed to the refining and chemical process must be neutralized, de-gassed, and sufficiently decontaminated before maintenance personnel can enter the vessel/equipment and begin maintenance activities on the vessels and equipment. While the decontamination, de-gassing and neutralization process is a necessity, the time required to neutralize, de-gas, and decontaminate the various components of a portion of a facility scheduled for maintenance adds to and increases the cost of a turnaround as it increases the time in which a process unit is offline. In addition, the increased time needed to decontaminate, de-gas, and neutralize the components of a facility, such as vessels and equipment is attributable to the many steps required to accomplish the decontamination, de-gassing, and neutralization process. This multiple step process also leads to increased waste production and increased costs from having to properly dispose of the increased waste production.

Accordingly, a need exists in the art for a system and method that allows components of a facility undergoing a turnaround, shut-down or maintenance, such as vessels and equipment, to be sufficiently and safely neutralized, de-gassed, and decontaminated in a timely manner and in such a manner that reduces waste production in order to reduce costs associated with waste disposal and down-time during maintenance activities, such as turnarounds and other planned outages.

BRIEF SUMMARY OF THE INVENTION

The present invention is directed to a system and method for de-gassing, decontaminating, and neutralizing various components of manufacturing units, such as refining units within a petrochemical refinery or other facility including, but not limited to, the vessels and equipment within a manufacturing process unit in order to quickly decontaminate, de-gas and neutralize said process unit in order to reduce the down-time experienced during a period of maintenance.

In one embodiment, a particular chemical solution is pre-blended in holding tanks and as the chemical solution is sufficiently blended, the solution will be pulled out of the holding tanks and circulated at a specific pressure and at a specific temperature and eventually fed into various refinery process components, such as vessels and tanks, and the chemical solution will circulate throughout the refinery process components and de-gas, decontaminate, and neutralize said components as the chemical solution circulates throughout the process components. In a preferred embodiment, the circulation of the particular chemical solution will effectively remove harmful hydrocarbons and benzene while at the same time neutralizing any polythionic acids that may be present in the equipment that is to be neutralized, de-gassed, and decontaminated.

The foregoing has outlined rather broadly the features and technical advantages of the present invention in order that the detailed description of the invention that follows may be better understood. Additional features and advantages of the invention will be described hereinafter, which form the subject of the invention. It should be appreciated that the conception and specific embodiment disclosed may be readily utilized as a basis for modifying or designing other structures for carrying out the same purposes of the present invention. It should also be realized that such equivalent constructions do not depart from the invention. The novel features which are believed to be characteristic of the invention, both as to its organization and method of operation, together with further objects and advantages will be better understood from the following description when considered in connection with the accompanying FIGURES. It is to be expressly understood, however, that each of the FIGURE(s) is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing(s), in which:

FIG. 1 is an illustration of an embodiment of the present invention that illustrates the implementation of one embodiment of the present invention.

DETAILED DESCRIPTION OF THE INVENTION

FIG. 1 is a diagram illustrating one embodiment of the present invention. In particular, FIG. 1 illustrates de-gassing, neutralizing, and decontamination system 100 or "DND" system 100. DND system 100, or de-gas/neutralize/decontaminate system 100 illustrates one embodiment of the present invention. As will be discussed in detail, DND system 100 is a system of circulating a specific chemical solution into process equipment 170 illustrated in FIG. 1. Process equipment 170 is process equipment in a manufacturing facility, such as a refinery or petrochemical manufacturing facility. In FIG. 1, process equipment 170 may be a series of exchangers identified as 170A-170E. While FIG. 1 illustrates process equipment 170 as a series of exchangers, the present invention is not limited to use on exchangers as it can be used on various equipment that is to be de-gassed, neutralized, and decontaminated. Through the present invention, the process equipment 170 (170A-170E) will be de-gassed, neutralized and decontaminated in a manner that will remove hydrocarbons and benzene and that will also protect Austenitic stainless steel process equipment from polythionic acid stress corrosion cracking.

As illustrated in FIG. 1, DND system 100 includes tanks 110. While FIG. 1 illustrates two tanks 110, the present invention is not limited to any particular number of tanks as the present invention may be configured with one tank or with more than one tank.

Tanks 110 may be any type of tank capable of storing large amounts of the chemical solution that is utilized in DND system 100. Tanks 110 may be single walled frac tanks that may be capable of storing in excess of 21,000 gallons. Frac tanks are ideal in that they are usually set up to be moved from location to location and therefore enable a user to utilize the present invention at several different locations. In addition, the use of frac tanks are ideal in that frac tanks will allow a user to use all of the fluid in a frac tank and allow such fluid to be emptied from the tank without the need to slope the tank to allow complete evacuation. While a frac tank is ideal in the present invention, any tank may be utilized for tank 110 as the frac tank is simply one example and does not limit the present invention.

In a preferred embodiment, tanks 110 are heater coiled tanks that are able to maintain the temperature of the chemical solution within tanks 110. Tanks 110 that are equipped with heater coils may be configured with multiple heating coils that allow steam to be piped in to heat the contents of the tanks 110.

DND system 100 may also comprise valves 111, illustrated as valves 111A and 111B that are configured so that a user can control the flow in and out of tanks 110. As illustrated in FIG. 1, valves 111A operate to allow the chemical solution within tanks 110 to exit out of tanks 110 and flow through piping 112. Valves 111B operate to allow the chemical solution to flow back in to tanks 110. In addition, valves 111 assist users in controlling the flow in and out of tanks 110. As the chemical solution flows out of tanks 110 through valves 111A, it will flow into piping 112.

Piping 112 is utilized throughout DND system 100. Piping 112 acts as the conduit through which the chemical solution may be transported through DND system 100 as illustrated in FIG. 1. Piping 112 may be temporary piping that is made of nylon, polyurethane, polyethylene, PVC, or synthetic or natural rubbers, special grades of polyethylene (LDPE and especially LLDPE), PTFE (Teflon), stainless steel and other metals as long as the material is compatible with the chemical solution within tanks 110.

DND system 100 also includes pump 120. Pump 120 is utilized to move the chemical solution out of tanks 110 and through DND system 100 as illustrated in FIG. 1. Pump 120 is sized so that it is capable of circulating the chemical solution through DND system 100 as discussed herein and may be configured to assist in circulating the chemical solution in either a forward or reverse flow scenario as discussed herein. In one embodiment, pump 120 is a temporary skid pump or pump mounted to a moveable skid so that the pump may be easily moved from one location to another that allows the present invention to be moved from one location to another as needed.

DND system 100 further includes a manifold 130. Manifold 130 is utilized to help control the direction of flow throughout DND system 100. In one embodiment, manifold 130 is a reverse flow manifold that enables the chemical solution within tank 110 to be moved by pump 120 through manifold 130 and eventually downstream and into process equipment 170, such as equipment 170A-170E. Manifold 130 may also be configured so that as the chemical solution circulates through process equipment 170 the chemical solution will exit process equipment 170 and flow back through manifold 130 and eventually back into tanks 110. A reverse flow manifold is simply one type of manifold that may be used in the present invention and is not a limitation upon the present invention.

In one embodiment, DND system 100 may also include flow meter 140. Flow meter 140 is utilized to monitor the flow throughout DND system 100. Flow meter 140 may be any type of flow meter that is capable of monitoring the rate at which the chemical solution is circulating through DND system 100. In one embodiment, flow meter 140 is configured so that it keeps track of the flow in gallons per minute. Flow meter 140 may be any type of flow meter such as a vortex, magnetic, positive displacement, or ultrasonic flow meter. The following are not limitations but merely examples of flow meters that may be utilized in the present invention. Monitoring the flow of the chemical solution through DND system 100 is critical as a threshold flow level is needed to obtain a certain degree of de-gassing, neutralizing, and decontamination. In configuring and running DND system 100, flow meter 140 will monitor the flow and if a minimum flow is not maintained, then a user may make adjustments to pump 120 so that a desired flow may be achieved. The location of flow meter 140 in FIG. 1 is for illustrative purposes only and not a limitation upon the present invention as flow meter may be located at different locations in DND system 100.

The present invention may also include temperature sensor 145 that is utilized to measure the temperature of the chemical solution as it circulates through DND system 100. Temperature sensor 145 may be any type of sensor capable of monitoring the temperature of the chemical solution of DND system 100 such as a thermocouple or an RTD. In one embodiment of the present invention, monitoring the temperature is also a key component of the present invention as a minimum temperature is needed to obtain a minimum level of de-gassing, neutralizing, and decontamination. Thus, a user of DND system 100 may continually monitor the temperature of the chemical solution of DND system 100 so that adjustments can be made to maintain a desired temperature of the chemical solution. The present invention may also include a heat source 150 to assist in maintaining a desired temperature. For example, if a desired temperature is not achieved, then a user may adjust heat source 150 or adjust a heating source that may be part of tanks 110 to assist a user in achieving a desired temperature. The location of temperature sensor 145 in FIG. 1 is for illustrative purposes only and not a limitation of the present invention. A user may locate temperature sensor 145 in a different location.

In one embodiment, the present invention may also include pressure sensor 146 that is utilized to measure the pressure while the neutralization process is ongoing. It is advantageous to maintain a set or constant temperature, pressure, and flow rate while operating. In using pressure sensor 146, a user is able to monitor the pressure so that adjustments may be made to maintain the desired pressure. If a desired pressure is not obtained, then a user may adjust various components of the present invention including, but not limited to pump 120, to obtain the desired pressure. The location of pressure sensor 146 in FIG. 1 is for illustrative purposes only and not a limitation of the present invention. A user may locate pressure sensor 146 in a different location.

Heat source 150 may also be part of DND system 100 to help maintain a set temperature of the chemical solution that is circulated through DND system 100 into process equipment 170. DND system 100 may be configured so that heat source 150 may be temporary steam that is utilized to increase the heat in the event that a desired minimum temperature is not maintained within DND system 100. If during operation of DND system 100, a desired temperature is not maintained, then a user may add heat through heat source 150, such as adding steam, to raise the temperature of the chemical solution of DND system 100. Then, a user can monitor the temperature with temperature sensor 145 and if a desired temperature is not achieved, then a user can adjust heat source 150 to increase or decrease the heat depending upon whether more or less heat is needed.

In one embodiment of the present invention, a gas sensor 155 may be installed so that user can monitor the chemical solution of DND system 100 for the presence of LEL combustible gasses, such as benzene. The location of gas sensor 155 in FIG. 1 is for illustrative purposes only and not a limitation of the present invention. A user may locate gas sensor 155 in a different location. While gas sensor 155 is illustrated in FIG. 1 as an instrument installed in-line in piping 112, this is not a limitation upon the present invention. In some embodiments, a user may not install a gas sensor 155, but may take random samples throughout the de-gassing, neutralizing, and decontamination process and analyze the sample for presence of LEL combustible gases. The user can then determine the effectiveness of the process based upon the results of the sampling. If LEL combustible gasses are still present in the sample, then the user may continue running the de-gassing, neutralizing, and decontamination process by continuing to circulate the chemical solution through the process equipment 170 until the sampling confirms that LEL combustible gases are not present or have been reduced to an acceptable limit.

In addition to gas sensor 155, the present invention may be configured to include pH sensors 190 to monitor the pH of the chemical solution as it circulates. In one embodiment, pH sensors may be some type or pH probes that are inserted into piping 112 to measure the pH of the chemical solution as it circulates through DND system 100. Monitoring the pH of the chemical solution as it flows through the process equipment 170 is an important component as it allows users to monitor the status of neutralization of the process equipment 170. For example, a user may circulate the chemical solution throughout the process equipment 170 until the user has reached a satisfactory pH level, such as 9 or above, to illustrate that the acids, such as polythionic acid has been neutralized indicating that the process equipment is neutralized. The location of pH sensor 190 in FIG. 1 is for illustrative purposes only and not a limitation of the present invention. A user may locate pH sensor 190 in a different location.

The various monitors/sensors of DND system 100, such as flow meter 140, temperature sensor 145, pressure sensor 146, gas sensor 155, and pH sensor 190 may be configured so that these monitors/sensors are connected to an instrumentation panel that may be located at a location remote from DND system 100. In an alternative embodiment, DND system 100 may also include an instrumentation/control panel whereby all data generated by the monitors/sensors of DND system 100, such as flow meter 140, temperature sensor 145, pressure sensor 146, gas sensor 155, and pH sensor 190 is collected at the instrumentation panel so that user may continuously monitor the temperature, rate of flow, presence of gas, and pH detected by the various sensors. In one embodiment, the instrumentation/control panel may be mounted to pump 120 or it may be a standalone structure located near the other components of DND system 100 so that a user may easily monitor temperature, rate of flow, and the presence of gas while DND system 100 is in use. The locations of the various sensors/monitors such as flow meter 140, temperature sensor 145, gas sensor 155, and pH sensor 190 illustrated in FIG. 1 are for illustrative purposes and not limitations to the present invention as the sensors may be located anywhere in DND system 100.

In addition, while the various sensors illustrated in FIG. 1, such as temperature sensor 145, pressure sensor 146, gas sensor 155, and pH sensor 190 are all illustrated as being installed in-line in piping 112, this is not a limitation upon the present invention. In some embodiments, said sensors may be arranged in a different configuration.

In one embodiment, DND system 100 may also be configured with second manifold 160. Manifold 160 may be a discharge manifold that allows the flow of the chemical solution of DND system 100 to enter into process equipment 170. In one embodiment of the present invention, the flow of the chemical solution of DND system 100 may flow out of tank 110, through valves 111, through piping 112, through manifold 130, past flow meter 140, past heat source 150, past gas sensor 155, and into manifold 160 so that the flow will continue through manifold 160 and into process equipment 170. Thus, if more than one piece of process equipment is in the process of getting de-gassed, neutralized, and decontaminated with DND system 100, then manifold 160 will be utilized to allow flow to travel into the process equipment.

In one embodiment, such as FIG. 1, process equipment 170 is five exchangers illustrated as 170A-170E. Thus, the chemical solution of DND system 100 is being circulated through all five exchangers making up process equipment 170. The exchangers illustrated in FIG. 1 are examples only as DND system 100 may be used with any manufacturing equipment and is not limited to the five exchangers illustrated in FIG. 1. As the flow progresses through DND system 100 into process equipment 170, DND system is operating to de-gas, neutralize, and decontaminate process equipment 170 by circulating the chemical solution of DND system 100 through the exchangers as a set temperature and flow rate.

DND system 100 may also be configured with a third manifold 180 and a sample point 185. Thus, as the flow proceeds through equipment 170, it can continue to flow through manifold 180 and past sample point 185. Sample point 185 may be a port, such as an in-line sample port or valve connected to DND system 100 that allows a user to sample the chemical solution of DND system 100 as it circulates in order to monitor various properties of the chemical solution as it circulates through DND system 100 and after it has circulated through process equipment 170. In an embodiment, the present invention will be configured with an in-line port that enables a user to take a sample of the chemical solution after it has circulated throughout the system and sample the temperature, and test the solution for the presence of acids, hydrocarbons, LEL's, benzene, and other similar chemicals. It is very important to sample and monitor the chemical properties of the solution after it flows through process equipment 170 so that a user may continuously monitor the progress of the de-gassing, neutralization, and decontamination and also determine whether the process has completely de-gassed, neutralized, and decontaminated the process equipment or if continued circulation is needed.

In one embodiment, DND system 100 may be configured so that circulation of the chemical solution is isolated to any particular piece of process equipment or any particular group of process equipment depending upon the make-up of process equipment 170. Thus, in one embodiment, such as that illustrated in FIG. 1, a user may configure manifolds 160 and 180 or other equipment of DND system 100 so that flow is restricted to exchangers 1 and 2 of process equipment 170 or restricted to exchangers 3, 4, and 5 of process equipment 170. After a user has isolated the flow and circulation of the chemical solution so that it flows through only one group of exchangers, then the user can monitor and test the chemical solution at sample point 185 and target the specific exchangers or equipment that have been isolated and verify if the isolated equipment has been sufficiently de-gassed, neutralized, and decontaminated.

Manifold 180 also allows the chemical solution of DND system 100 to flow out of the process equipment 170 and into piping 112 as illustrated at return flow point 186 so that the flow may continue back to manifold 130. Manifold 130 may then enable the flow to continue back to tanks 110. When the flow of the chemical solution of DND system 100 has circulated back to tanks 110, the chemical solution will re-enter tanks 110 and be mixed with the chemical solution still in tanks 110.

In one embodiment of the present invention, the flow of the chemical solution of DND system 100 is illustrated as flowing out of tanks 110 and on toward pump 120 and eventually into process equipment 170 as illustrated by flow arrows 113 of FIG. 1. The dotted lines of piping 112 from tanks 110 to process equipment 170 represents a discharge normal flow of the chemical solution in tanks 110 to process equipment 170. The solid lines of piping 112 out of process equipment 170 back to tanks 110 represents the return normal flow back into tank 110. Thus, a normal flow of the chemical solution in DND system 100 is the solution flowing out of tanks 110 through piping 112, into process equipment 170 and eventually back to tanks 110 as illustrated by flow arrows 113 in FIG. 1.

To assist with the de-gassing, neutralizing, and decontaminating process, DND system 100 can be configured so that during the de-gassing, neutralizing, and decontaminating process, the flow of the chemical solution can be reversed on a periodic basis to assist in removing and preventing scale and debris build-up in process equipment 170. Reverse flow would simply consist of the chemical solution flowing in a direction opposite of the flow arrows 113. In one embodiment, DND system can be configured so that the chemical solution will be circulated in a reverse flow direction periodically throughout the flow process. For example, DND system 100 can be configured so that the chemical solution will be set to reverse flow every 2 hours and will reverse flow for a 30 to 60 minute interval. This example is not a limitation of the present invention, but merely an example.

In one embodiment of the present invention, DND system 100 may also be configured with carbon canister 115. Carbon canister 115 is used as a safeguard and operates to scrub any excess gasses that may evaporate from tanks 110. Canister 115 is connected to tanks 110 via piping 112 as illustrated in FIG. 1. DND system 100 is configured for safe operation and to comply with various regulations concerning air quality. With the use of canister 115, any gases exiting tanks 110 will be scrubbed so that no harmful gases will escape into the atmosphere.

The flow process of DND system 100 is a continuous process in that the chemical solution of DND system 100 continually flows and circulates from tank 110, through valve 111A, through piping 112, past temperature sensor 145, pressure sensor 146, to pump 120, to manifold 130, to flow meter 140, to gas sensor 155, through manifold 160, into process equipment 170 (which in the example illustrated in FIG. 1 consists of five exchangers 170A-170E), then through manifold 180, back through manifold 130 and eventually back to tanks 110. This flow/circulation of the chemical solution of DND system 100 will continue for any length of time until the process equipment, such as the exchangers 170A-170E illustrated in FIG. 1, to be de-gassed, neutralized, and decontaminated has been sufficiently de-gassed, neutralized, and decontaminated.

An advantage of the present invention is that it operates to remove various pollutants from process equipment 170. As the chemical solution of DND system 100 circulates, unwanted pollutants will eventually be carried with the flow to tanks 110. The pollutants may include various non-soluble chemicals. And, as the pollutants get to tank 110, the pollutants will sink to the bottom of tank 110. Thus, the pollutants are removed from the process equipment and this removal helps in the de-gassing, neutralization, and decontamination of process equipment 170.

A key component of the present invention, illustrated by DND system 100 is the chemical solution that circulates through the various components illustrated in FIG. 1. In one embodiment of the present invention, the chemical solution is comprised of various mixtures of chemicals that include: an ethoxylated alkylphenol at a weight of 5-20%, an ethoxylated alcohol at a weight of 5-20%, a dibasic fatty acid, a surfactant, a triethanolamin dobecylbenzene, a sulfonate surfactant, sodium carbonate or soda ash, and sodium nitrate, all mixed with water to create a chemical package that will decontaminate, neutralize, and de-gas the process equipment 170. The chemical solution set forth herein are merely examples of preferred solutions that may be utilized but are not limitations of the claimed invention.

The specifically formulated chemical solution is further advantageous in that the emulsion of the chemical solution with any hydrocarbons and any solids from the process equipment 170 will remain stable during rinsing so that waste generated may be processed and drained to oily water sewer. Thus, there is no need for a specific disposal and the end user may simply drain any remaining solution after rinsing directly into oily water sewer. Because the waste may be disposed of via the oily water sewer, an end user may recognize a significant cost savings in that an end user is no longer required to use a specialized waste disposal because waste generated from the present invention may be disposed of to the oily water sewer.

By de-gassing, neutralizing, and decontaminating process equipment 170, the present invention is also protecting the process equipment from polythionic acid stress corrosion cracking while the process equipment is shut-down for periods of maintenance. In addition, the specifically formulated chemical solutions and packages that act to de-gas, neutralize, and decontaminate the process equipment are formulated as non-hydrocarbon chemistry with the various wetting agents, dispersants, and blended with neutralizing solutions that will readily aid in the removal of LEL's and benzene while at the same time neutralizing any potential polythionic acid that can or has formed within the process equipment 170.

Any hydrocarbons are emulsified in the specifically formulated chemical solution allowing for easy removal of such hydrocarbons from the process equipment 170.

Because the specifically formulated solution is able to de-gas, neutralize, and decontaminate at the same time in one step, process equipment may be available for maintenance much faster than the normal two-step process. Thus, the present invention may save an end user up to 24 hours so that process equipment 170 may be available for maintenance approximately 24 hours sooner with the use of the present invention.

In a preferred embodiment, the present invention is configured so that the chemicals comprising the chemical solution of DND system 100 are pre-blended and pre-heated at a range of 120-180° F. and after the chemical solution has been sufficiently blended and heated, it is transferred into tanks 110. In an alternative embodiment, the selected chemicals comprising the chemical solution of DND system 100 may be blended within tank 110 at a desired temperature of 120° F. After the desired chemical solution is sufficiently blended, it is circulated throughout DND system 100. In a preferred embodiment, the chemical solution of DND system 100 is circulated at 200 gallons per minute.

As DND system 100 is operating with the chemical solution circulating throughout the various components and through the process equipment 170 that is to be de-gassed, neutralized, and decontaminated, a user can either utilize the in-line sample port 185 or the various sensors (flow meter 140, temperature sensor 145, pressure sensor 146, gas sensor 155, pH sensor 190) to continuously monitor the solution for the presence of various chemicals, such as hydrocarbons, LEL's, and benzene. In a preferred method of operation, a user will allow the chemical solution to circulate for a set period of time, approximately 4 hours and then check the solution for the presence of hydrocarbons, LEL's, benzene, or any other chemicals of interest. If the sampling indicates that hydrocarbons, LEL's, benzene or other chemicals of interest are still present, then a user can add additional blended chemical solution to DND system 100 (via tank 110 or other entry port) to continue running throughout the DND system 100 to further de-gas, neutralize, and decontaminate the process equipment 170. In one embodiment, a user can continuously monitor the pH of the solution via pH sensor 190. By monitoring the pH a user is able to monitor the progress of neutralization in that once the pH of the solution is at 9 or above, the process equipment has been neutralized.

After the chemical solution has circulated throughout the process equipment 170 and the samples taken and various sensors indicate that the solution is neutral and the equipment has also been de-gassed and decontaminated, then the system can be configured for rinsing. Rinsing is the process whereby the process equipment 170 will be rinsed with a low chloride water rinse. In one embodiment, the rinse will consist of a water based solution that is less than 50 ppm chloride. This solution will be circulated through the process equipment to ensure that the process equipment 170 has been de-gassed, neutralized, and decontaminated. In one embodiment, when the process equipment is ready to be rinsed, then the tanks 110 will be drained of the chemical solution and any pollutants present from the circulation through process equipment 170. Once the tanks 110 are cleaned and emptied, then the tanks may be filled with the low chloride water rinse and this rinsing solution will be circulated through the process equipment.

Although the present invention and its advantages have been described in detail, it should be understood that various changes, substitutions and alterations can be made herein without departing from the invention. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized.

What is claimed is:

1. A system for de-gassing, decontaminating, and neutralizing equipment comprising:

at least one tank containing a liquid composition whereby said liquid composition can assist in reducing the quantity of hydrocarbons and benzene;

a plurality of valves that assist in controlling flow of said liquid composition in and out of said tank;

pipe members wherein said pipe members are arranged so that said liquid composition can flow out of said tank through said equipment and back to said tank;

a pump for moving said liquid composition in and out of said tank, through said valves, through said pipe members and eventually in said equipment to be de-gassed, decontaminated and neutralized;

a first manifold to assist in controlling direction of flow of said liquid composition;

a second manifold for connecting piping to said equipment to be de-gassed, decontaminated and neutralized so that said liquid composition in said tank may be circulated to said equipment;

a third manifold for controlling flow of said liquid composition out of said equipment and into said piping so that said liquid composition may flow back into said tank after circulating through said equipment; and a heat source for applying heat to said liquid composition.

2. The system of claim 1 further comprising:

a flow meter for measuring the flow rate of said liquid composition.

3. The system of claim 2 further comprising:

a temperature sensor for measuring the temperature of said liquid composition.

4. The system of claim 1 further comprising:

a pressure sensor for measuring the pressure within said system.

5. The system of claim 3 further comprising:

a gas sensor for monitoring the presence of various chemicals in said liquid composition as it circulates in said system.

6. The system of claim 1 further comprising:

a pH sensor for measuring the pH of said liquid composition as it circulates in said system.

7. The system of claim 1 further comprising:

a sample port whereby a user of said system can obtain samples of said liquid composition as it circulates through said system.

8. The system of claim 3 further comprising:

a second tank containing said liquid composition.

9. The system of claim 8 further comprising:

a carbon canister operating to scrub excess gasses that may evaporate from either said first tank or said second tank.

10. The system of claim 9 wherein said tanks are single walled heater coiled frac tanks capable of maintaining said liquid composition at a set temperature.

11. The system of claim 10 wherein said liquid composition comprises:
an ethoxylated alkylphenol at a weight of 5-20%;
an ethoxylated alcohol at a weight of 5-20%;
a dibasic fatty acid;
a surfactant;
a triethanolamin dobecylbenzene;
sodium carbonate; and
sodium nitrate.

12. A method for de-gassing, decontaminating, and neutralizing equipment comprising:
mixing chemicals to create a liquid composition so that said liquid composition comprises:
an ethoxylated alkylphenol at a weight of 5-20%;
an ethoxylated alcohol at a weight of 5-20%;
a dibasic fatty acid;
a surfactant;
a triethanolamin dobecylbenzene;
sodium carbonate; and
sodium nitrate
providing a system for de-gassing, decontaminating, and neutralizing equipment wherein said system comprises:
at least one tank containing said liquid composition;
a plurality of valves that assist in controlling flow of said liquid composition in and out of said tank;
a flow meter for measuring the flow rate of said liquid composition;
a temperature sensor for measuring the temperature of said liquid composition;
pipe members wherein said pipe members are arranged so that said liquid composition can flow out of said tank through said equipment and back to said tank;
a pump for moving said liquid composition in and out of said tank, through said valves, through said pipe members and eventually in said equipment to be de-gassed, decontaminated and neutralized and then back to said tank;
a first manifold to assist in controlling direction of flow of said liquid composition;
a second manifold for connecting piping to said equipment to be de-gassed, decontaminated and neutralized so that said liquid composition in said tank may be circulated to said equipment;
a third manifold for controlling flow of said liquid composition out of said equipment and into said piping so that said liquid composition may flow back into said tank after circulating through said equipment;
a sample port whereby a user of said system can obtain samples of said liquid composition as it circulates through said system and
a heat source for applying heat to said liquid composition; and
operating said pump so that said liquid composition is circulated in a path of flow traveling from said tank, through said first manifold, through said second manifold, through said equipment to be de-gassed, decontaminated, and neutralized, out of said equipment, through said third manifold, and back into said tank.

13. The method of claim 12 further comprising the steps of:
periodically operating said sample port to obtain a sample of said liquid composition as it circulates through said equipment;
analyzing said sample of said liquid composition for the presence of certain chemicals;
stopping flow of said liquid composition through said equipment when certain criteria are satisfied;
circulating a rinsing liquid through said equipment after said flow of said liquid composition has stopped; and
draining any waste to proper disposal location.

14. The method of claim 13 wherein said system further comprises:
a pressure sensor for measuring the pressure within said system.

15. The method of claim 14 wherein said system further comprises:
a gas sensor for monitoring the presence of various chemicals in said liquid composition as it circulates in said system.

16. The method of claim 15 wherein said system further comprises:
a pH sensor for measuring the pH of said liquid composition as it circulates in said system.

17. The method of claim 16 wherein said system further comprises:
a second tank containing said liquid composition wherein said tanks are single walled heater coiled frac tanks capable of maintaining said liquid composition at a set temperature; and
a carbon canister operating to scrub excess gasses that may evaporate from either said first tank or said second tank.

18. A system for de-gassing, decontaminating, and neutralizing equipment comprising:
at least one tank containing a liquid composition wherein said liquid composition comprises:
an ethoxylated alkylphenol at a weight of 5-20%;
an ethoxylated alcohol at a weight of 5-20%;
a dibasic fatty acid;
a surfactant;
a triethanolamin dobecylbenzene;
sodium carbonate; and
sodium nitrate;
a plurality of valves that assist in controlling flow of said liquid composition in and out of said tank;
a flow meter for measuring the flow rate of said liquid composition;
a temperature sensor for measuring the temperature of said liquid composition;
a pressure sensor for measuring the pressure within said system;
a gas sensor for monitoring the presence of various chemicals in said liquid composition as it circulates in said system;
a pH sensor for measuring the pH of said liquid composition as it circulates in said system;
pipe members wherein said pipe members are arranged so that said liquid composition can flow out of said tank through said equipment and back to said tank;
a pump for moving said liquid composition in and out of said tank, through said valves, through said pipe members and eventually in said equipment to be de-gassed, decontaminated and neutralized;
a first manifold to assist in controlling direction of flow of said liquid composition wherein said manifold may be configured to reverse the flow of said liquid composition through said system;
a second manifold for connecting piping to said equipment to be de-gassed, decontaminated and neutralized so that said liquid composition in said tank may be circulated to said equipment;
a third manifold for controlling flow of said liquid composition out of said equipment and into said piping so that said liquid composition may flow back into said tank after circulating through said equipment;

a sample port whereby a user of said system can obtain samples of said liquid composition as it circulates through said system; and a heat source for applying heat to said liquid composition.

19. The system of claim 18 further comprising:

a carbon canister operating to scrub excess gasses that may evaporate from said tank.

* * * * *